United States Patent [19]

Zerrer

[11] 3,969,856

[45] July 20, 1976

[54] ADJUSTABLE PROTECTIVE HOOD FOR A ROTARY TOOL

[75] Inventor: Gerhard Zerrer, Korb, Germany

[73] Assignee: Andreas Stihl Maschinenfabrik, Neustadt, Germany

[22] Filed: Sept. 20, 1974

[21] Appl. No.: 507,806

[30] Foreign Application Priority Data

Sept. 25, 1973 Germany ..... 7334640[U]

[52] U.S. Cl. ..... 51/268; 144/251 R

[51] Int. Cl.[2] ..... B24B 55/04; B27G 19/04

[58] Field of Search ..... 51/268, 269, 272; 144/251 R

[56] References Cited

UNITED STATES PATENTS 3,591,989 7/1971 Granlie ..... 51/268

3,606,707 9/1971 Naslund ..... 51/268

*Primary Examiner*—Al Lawrence Smith
*Assistant Examiner*—Nicholas P. Godici
*Attorney, Agent, or Firm*—Walter Becker

[57] ABSTRACT

A hood for a rotary tool, such as a grinding wheel on a saw or the like, in which the hood is rotatable about the axis of the tool and is spring clamped in adjusted rotary positions. A lever pivoted to the hood has a neutral position in which the clamp is effective for clamping the hood while the lever is moveable in either direction from the neutral position thereof for unclamping the hood while simultaneously adjusting the hood in the same direction.

15 Claims, 10 Drawing Figures

ADJUSTABLE PROTECTIVE HOOD FOR A ROTARY TOOL

The present invention relates to a protective device for a cutting-off grinder with a protective hood which surrounds a portion of the circumference of the tool and which is pivotable about the tool axis relative to a bearing for the tool and which is so mounted as to be arrestable by an arresting device, the arresting element of said arresting device being connected to a handle movable between a disengaging and arresting position and having a counter-element associated therewith.

It is an object of the present invention to provide a protective device of the above mentioned type in such a way that a fast and safe adjustment of the protective hood about its pivot axis will be assured. These and other objects and advantages of the invention will appear more clearly from the following specification in connection with the accompanying drawing, in which.

The protective device according to the present invention is characterized primarily in that the handle of the arresting device is mounted on the protective hood so that the handle can by one grasp move into disengaging position while simultaneously the protective hood can by movement of the handle about the pivot axis of the protective hood be moved into the desired position. In this way, it is no longer necessary in contrast to a heretofore known protective device in which the handle is fixedly mounted on the device, to disengage the arresting device by a first action and thereupon by a separate second action to adjust the protective hood. According to a simple embodiment of the present invention, the handle is movably mounted approximately in the pivoting direction of the protective hood. The handle preferably has the arresting position located between two disengaging positions so that when pivoting the handle in either direction, it will first reach its disengaging position and will then move the protective hood in the pertaining pivoting direction.

Figure 1:
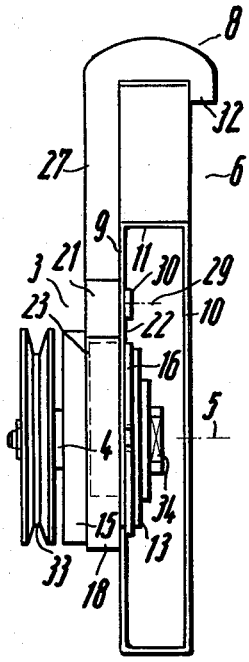
FIG. 1 shows a view of a protective device according to the invention.
Figure 2:
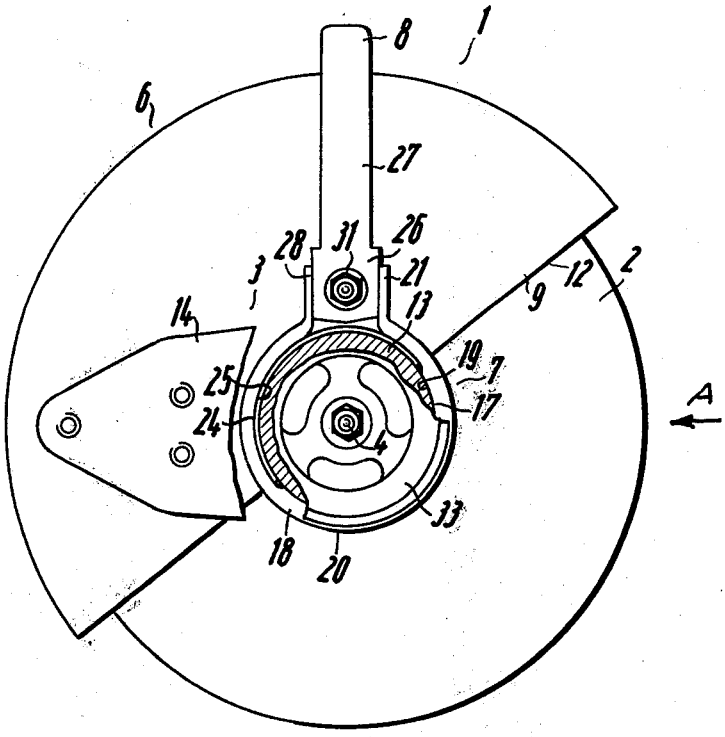
FIG. 2 shows the protective device of FIG. 1 in end elevation as seen in the direction of the arrow A in FIG. 1 but without the tool.
Figure 8:
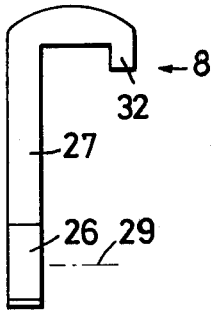
FIG. 8 is an elevational view of the handle of FIG. 7.
Figure 7:
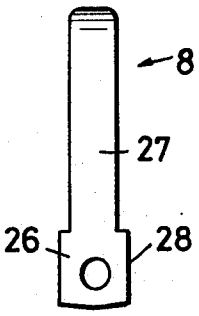
FIG. 7 is an end view of a handle used in FIGS. 1 and 2.
Figure 6:
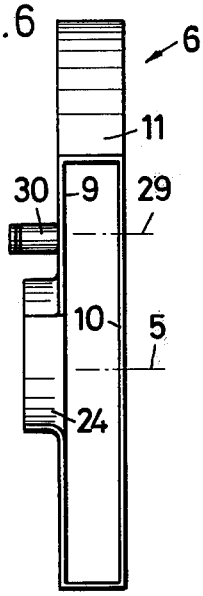
FIG. 6 is an end view of the hood of FIG. 5.
Figure 5:
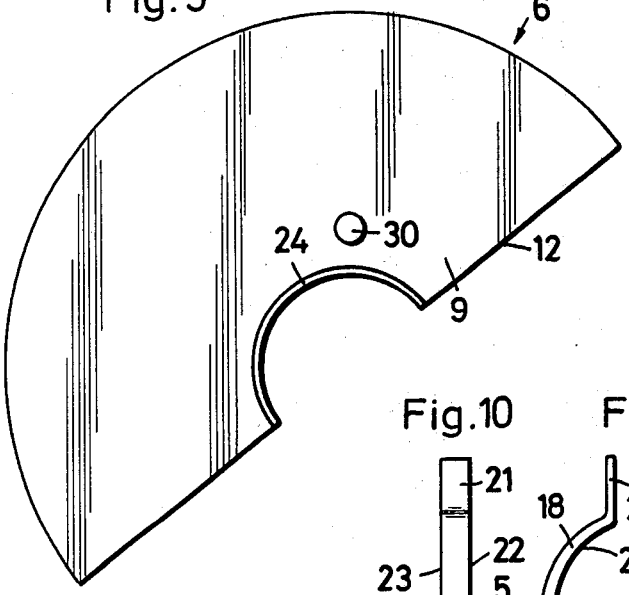
FIG. 5 is an elevational view of a protective hood used in FIGS. 1 and 2.
Figure 10:
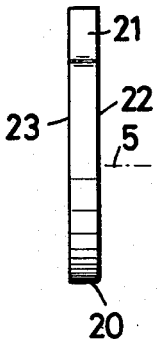
FIG. 10 is an end view of the arresting element of FIG. 9.
Figure 9:
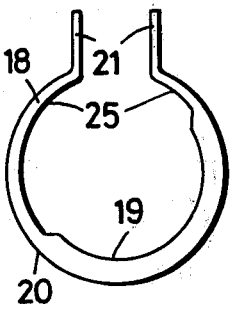
FIG. 9 is an elevational view of an arresting element used in FIGS. 1 and 2.
Figure 4:
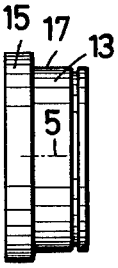
FIG. 4 is an end view of the bearing of FIG. 3.
Figure 3:
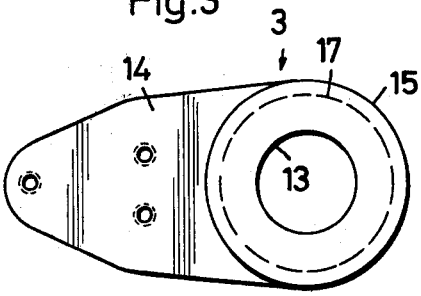
FIG. 3 is an elevational view of a bearing used in FIGS. 1 and 2.

Referring now to the drawing in detail, the arrangement shown in FIGS. 1 and 2 illustrates a protective device 1 according to the invention for a rotary tool for instance a cutting-off grinder disc 2. The protective device, furthermore comprises a protective hood 6 which is pivotally mounted on a bearing 3 for the tool shaft 4 while being pivotable about the tool axis 5. The protective hood 6 is arrestable as shown in FIG. 1 by means of an arresting device 7 comprising a handle 8 effective in the respective pivoting position relative to the bearing 3.

The protective hood 6 comprises two planar parallel side walls 9, 10 which are spaced from each other by a distance exceeding the thickness of the tool 2. Of these side walls, the side wall 9 on the driving side is approximately semicircular, whereas the other side wall 10 which is symmetrical to the central plane of the side wall 9 may spring back at that edge thereof which faces toward the tool 2 having an axis 5, and for instance may be rounded in a concave manner. The two side walls 9, 10 are interconnected by means of a strip-shaped hood mantle 11 which extends in a cylindrical manner around the tool axis 5 and the ends of which are located in the same plane as the secant 12 of the side wall 9. The bearing 3 has a bearing sleeve 13 located in the tool axis 5, and furthermore has a connecting arm 14 which radially extends away from said sleeve 13. The bearing 3 may be connected to the connecting arm 14 on a suitable driving device, for instance a boom of the driving unit of a motor chain saw. The connecting arm 14 is arranged in spaced relationship to the outside of the side wall 9 of the protective hood 6 which is located on the driving side. The bearing sleeve 13 which through an increasing end collar 15 located outside the protective hood 6 merges with the connecting arm 14, extends up to the inside of that side wall 9 of the protective hood 6 which is located on the driving side and within this region, in an outer circumferential groove carries a resilient safety ring 16 which engages the inside of the side wall 9. Between the end collar 15 and the end face provided at the other end, the bearing sleeve 13 has a substantially constant outer diameter, in other words a cylindrical outer circumferential surface 17.

Between that side wall 9 of the protective hood 6 which is located on the driving side, and the end collar 15 of the bearing 3, an arresting element 18 is arranged on the bearing sleeve 13 in the manner of a split clamp. The inner surface of said arresting member 18 which is substantially coaxial with the tool axis 5 forms a clamping surface 19 while its outer circumferential surface 20 which is slightly eccentrically located with regard to the clamping surface 19 is so arranged that the cross sectional thickness of the adjusting member 18 measured radially with regard to the tool axis 5 is greater in that region which is located opposite its leg ends 21. The outer circumferential surface 20 is likewise cylindrical and the arresting element 18 has plane parallel end faces 22, 23 which are at a right angle to the tool axis 5. One of the end faces 22, 23 namely the end face 22 engages the arresting element 18 at the outside of that side wall 9 of the protective hood which is located adjacent to the drive, whereas the other end face 23 of said arresting member 18 engages that end face of the end collar 15 of bearing 3, which end face faces toward the arresting member 18. In this way, the arresting member 18 is axially secured relative to the bearing 3 and the protective hood 6 in the direction of the tool axis 5 in a very simple manner. The leg ends 21 of the arresting member 18 are approximately parallel to each other and are preferably directed away from the pivot axis 5 of the protective hood 6. In this way, in spite of a high adjusting force of the arresting member 18 the arresting device can relatively easily be disengaged. Moreover, the leg ends 21 have a relatively long length while no recess or the like is necessary in the countermember for the leg ends 21 as is the case when the leg ends 21 occupy a position directed toward the pivot axis 5.

The protective hood 6 has a bowl-shaped bearing member 24 which has its entire cylindrical inner surface engage the countersurface 17 of the bearing sleeve 13. The bearing member 24 may form one piece with that side wall 9 which is located on the driving side, said bearing member 24 projecting beyond the outside of said side wall and projecting by a distance equalling the axial extension of the arresting member 18. The bearing member 24 engages a recess 25 on the clamping surface 19 of the countermember 18 in such a way that its cylindrical outer circumferential surface engages nearly over the entire surface the inner surface of said recess 25, which, however, is provided with a radius which is greater than the countersurface 17 by the thickness of the bearing member 24. By means of said bearing member 24, the protective hood 6 is braced directly relative to the bearing 3 so that the arresting member 18, especially when it has the design of a split clamp, does not have to be connected directly to the protective hood 6 and still assures a safe mounting of the protective hood 6. The recess 25 which extends on both sides of the gap between the leg ends 21 of the arresting member 18 has an arc angle about the tool axis 5 which angle approximately equals the corresponding arc angle of the bearing member 24, the arc angle of which equals that of the protective hood 6 and that wall 9 which is located on the driving side, namely 180°, the bearing member 24 bridging the gap between the leg ends 21 of the arresting member 18. In view of the entire recess 25 which extends over the entire axial extension of the arresting member 18, the cross section of the arresting member 18 is within the region of this recess additionally reduced so that the arresting member 18 will be able particularly in this region to spread well. On both sides of the gap between the leg ends 21 of the arresting member 18, the recess 25 extends over arc angles of different magnitude while said recess 25 on that side which faces the connecting arm 14 — in the intermediate position of the protective hood 6 — extends over the greater arc angle. The recess 25 may, however, also extend on both sides of said gap over the same arc angle, in other words may be symmetrically designed relative to the axial plane of the tool axis 5, which axial plane is located between the leg ends 21. The clamping surface 19 which directly engages the counter-element may on one hand be formed by the bearing member 24 and on the other hand may be formed adjacent thereto by the arresting member 18.

Between the leg ends 21 of the arresting member 18 there extends an actuating element 26 which is connected to the handle 8 through the intervention of a connecting piece 27 forming an arm. The actuating element 26 has those side surfaces 28 thereof which face away from each other engage those inner surfaces of the leg ends 21 which face each other. More specifically, said side surfaces 28 engage nearly said entire inner surfaces of the leg ends 21, while the leg ends 21 located symmetrically on both sides on an axial plane of the tool axis 5 are directed outwardly and are located opposite each other while they may extend outwardly at a small angle away from each other. The leg ends 21 are formed by the bent-off ends of the arresting member 18. For purposes of obtaining better lever conditions, the actuating member 26 is pivotable about a pivot axis 29 located in the above mentioned axial plane and by means of a bolt 30 is journaled on the protective hood 6 and that side wall 9 respectively which is located on the driving side. The pivot axis 29 is parallel to the tool axis 5 and is located at a slight distance from the outer circumference of the bearing sleeve 13 in such a way that the actuating element 26 in the manner of a two-arm lever projects in both directions of the connecting line between the axes 5, 29 beyond the pivot axis 29 as is also the case for the leg ends 21. The actuating element 26 is symmetrically designed with regard to the common axial plane of the axes 5, 29 and is slightly wider than the connecting member 27 which latter with the actuating member 26 and the handle 8 forms a single one-piece structural element for instance of synthetic material. The actuating element 26 has a bore engaged by a nut 31 mounted on the outside of the actuating member 26 on a bolt 30. The connecting member 27 located symmetrically with regard to the common axial plane of the axes 5, 29 extends along the outside of that side wall 9 of protective hood 6 which is located on the driving side, and leads to the circumference of said hood 6 where it merges with the handle 8 which is likewise symmetrically designed with regard to said axial plane. The handle 8 extends from the connecting member 27 transverse over the mantle part 11 of the hood 6 and extends by means of a leg 32 directed toward the tool axis 5 over the oppositely located side wall 10 on the outside so that the substantially U-shaped handle 8 including the connecting member 27 is in the direction of the tool axis 5 secured relative to the protective hood 6 and is easily accessible. Since the handle 8 is in spaced relationship to the arresting element 18 axially secured and guided relative to the protective hood 6, the handle 8 may be safely held even with a light weight structure. The actuating element 26 nearly extends to the outer circumference of the bearing member 24. Since the actuating member 26 is located within the region of the pivot axis 29 of handle 8, preferably symmetrically thereto, particularly favorable lever conditions are realized.

On that side of the end collar 15 of bearing 3 which faces away from the protective hood 6, a belt pulley 33 is arranged on the tool shaft 4. By means of this pulley 33, the tool shaft 40 may be drivingly connected with a drive unit. Within the protective hood 6 at the pertaining end of the tool shaft 4, there is provided a multi-side connecting flange 34 for exchangeably connecting the tool 2. This connecting flange 34 may for instance have a multi-sided head. For an infinitely fine adjustment of the protective hood 6 around the tool axis 5, it is merely necessary to press the handle 8 into the desired adjusting direction. The actuating member 26 will then be changed in its position about the pivot axis 29 so that the leg ends 21 are pressed away from each other and the adjusting member 18 is spread in such a way that the frictional connection by which the arresting member 18 and the bearing member 24 engage the countersurface 17, will be reduced and the protective hood 6 will be taken along in the corresponding direction of rotation. Immediately after releasing the handle 8, the latter returns to its starting position according to FIG. 1 as a result of which also the originally prevailing frictional connection between the springing back arresting member 18 and the countersurface 17 between the bearing member 24 pressed on by the arresting member 18 and the countersurface 17 occurs so that the protective hood 6 will automatically be arrested in its new position. In this way at any rate any working with not arrested protective hood will be prevented.

It is, of course, to be understood that the present invention is, by no means, limited to the specific showing in the drawing but also comprises any modifications within the scope of the appended claims.

What is claimed is:

1. A protective device for a rotary tool such as a grinding wheel comprising; a hood having a peripheral portion surrounding a portion of said tool in radially spaced relation thereto, said hood having side walls at the sides of said tool and connected to said peripheral portion, stationary means engaging one of said side walls and supporting said hood for pivotal movement substantially on the axis of said tool, clamp means operable to clamp said hood in adjusted positions of pivotal movement thereof, and a lever pivotally connected to said hood and operatively connected to said clamping means and operable when moved in a respective direction about the pivotal connection thereof with the hood to release said clamp means momentarily and to permit automatic movement of the hood in the same said direction.

2. A protective device according to claim 1 in which said lever is moveable in opposite directions about the pivotal connection thereof with said hood and is operable to release said clamp means in each said direction of movement, said lever having a neutral position in which said clamp means is clamped.

3. A protective device according to claim 1 in which the axis of the pivotal connection of said lever with said hood is parallel to the axis of the tool and radially spaced therefrom.

4. A protective device according to claim 1 in which said lever extends radially along the outer side of said one side wall and has an axial portion extending over said peripheral portion of said hood, said axial portion being disposed within the circumferential limits of said peripheral portion of said hood, the axis of the pivotal connection of said lever to said hood being parallel to the axis of the tool and spaced radially therefrom toward said axial portion of said lever.

5. A protective device according to claim 1 in which said clamp means is spring urged toward clamping position, said lever comprising a cam portion responsive to tilting of said lever about the pivotal connection thereof to said hood to overcome the spring bias on said clamping means.

6. A protective device according to claim 5 in which said cam portion is adjacent said pivotal connection of the lever to said hood, and is operative for overcoming the spring bias on said clamping means in response to movement of said lever in either direction from a neutral position thereof.

7. A protective device according to claim 1 which includes a pivot bolt extending through said one side wall of the hood and pivotally supporting said lever on said hood.

8. A protective device according to claim 1 in which said clamping means comprises a radially resilient annular spring element coaxial with the axis of the tool, and said stationary means comprising a nonrotatable bearing ring which said spring element embraces and which is frictionally engaged by said spring element.

9. A protective device according to claim 8 in which said spring element is rotatable about the tool axis on said bearing ring when the spring element is radially expanded.

10. A protective device according to claim 8 in which said spring element is solid in cross section and is open on one side and increases in cross sectional area from said open side to the region thereof which is opposite said open side.

11. A protective device according to claim 10 in which said spring element is uniform in axial dimension about the entire periphery thereof, a collar on said bearing ring on one side of said spring element, said one side wall of the hood engaging the other side of said spring element, a tool drive shaft rotatable in said bearing ring, and a drive pulley on the shaft which is about the same diameter as said spring element.

12. A protective device according to claim 8 in which said bearing ring is cylindrical.

13. A protective device according to claim 8 which includes an axial portion on said one side wall of said hood extending along said bearing ring, said axial portion embracing a portion only of the periphery of said bearing ring, said spring element having an internal notch receiving said axial portion and preventing relative rotation of said hood and spring element.

14. A protective device according to claim 8 which includes a support arm connected to said bearing ring.

15. A protective device according to claim 10 in which said spring element is uniform in axial dimension about the entire periphery thereof, a collar on said bearing ring on one side of said spring element, said one side wall of the hood engaging the other side of said spring element, and snap ring means on said bearing ring on the inside of said one side wall of said hood.

* * * * *